US007854665B2

(12) United States Patent
Dewhurst et al.

(10) Patent No.: US 7,854,665 B2
(45) Date of Patent: Dec. 21, 2010

(54) GOLF CLUB HEAD

(75) Inventors: Peter Dewhurst, West Kingston, RI (US); Michael C. Apostal, Saunderstown, RI (US)

(73) Assignee: Dewhurst Solution, LLC, Hope Valley, RI (US)

( * ) Notice: Subject to any disclaimer, the term of this patent is extended or adjusted under 35 U.S.C. 154(b) by 985 days.

(21) Appl. No.: 11/246,561

(22) Filed: Oct. 7, 2005

(65) Prior Publication Data

US 2006/0068936 A1 Mar. 30, 2006

Related U.S. Application Data

(63) Continuation of application No. PCT/US2004/23368, filed on Jul. 22, 2004, and a continuation-in-part of application No. PCT/US03/11085, filed on Apr. 11, 2003.

(51) Int. Cl.
*A63B 53/04* (2006.01)

(52) U.S. Cl. ..... 473/329; 473/340; 473/346; 473/350

(58) Field of Classification Search ..... 473/324–350
See application file for complete search history.

(56) References Cited

U.S. PATENT DOCUMENTS

| | | | | |
|---|---|---|---|---|
| 3,814,437 | A | 6/1974 | Winquist | 273/167 |
| 3,989,248 | A | 11/1976 | Campau | 273/78 |
| 4,076,254 | A | 2/1978 | Nygren | 273/173 |
| 4,511,145 | A | 4/1985 | Schmidt | 273/167 |
| 4,988,104 | A | 1/1991 | Shiotani et al. | 273/167 |
| 5,000,454 | A | 3/1991 | Soda | 273/167 |
| 5,154,425 | A | 10/1992 | Niskanen et al. | 273/167 |
| 5,176,383 | A | 1/1993 | Duclos | 273/167 |
| 5,295,689 | A | 3/1994 | Lundberg | |
| 5,318,300 | A | 6/1994 | Schmidt et al. | 273/167 |
| 5,346,216 | A | 9/1994 | Aizawa | 273/167 |
| 5,362,055 | A | 11/1994 | Rennie | 273/167 |
| 5,377,985 | A | 1/1995 | Ohnishi | 273/169 |
| 5,451,058 | A * | 9/1995 | Price et al. | 473/340 |
| 5,482,279 | A | 1/1996 | Antonious | 273/167 |
| 5,499,814 | A | 3/1996 | Lu | 273/78 |

(Continued)

FOREIGN PATENT DOCUMENTS

| | | |
|---|---|---|
| JP | 10146404 | 2/1998 |

(Continued)

OTHER PUBLICATIONS

AGM Michell, "The Limit of Economy of Material in Frame Structures," *Philosophical Magazine*, vol. 8, No. 47, Nov. 1904, pp. 589-597.

(Continued)

*Primary Examiner*—Sebastinano Passaniti
(74) *Attorney, Agent, or Firm*—Karen A. Buchanan

(57) ABSTRACT

A golf club head designed to act under impact load as a bridge comprising a face; an inertial support system; a rear structure; and a force transfer system, under impact load the force transfer system, in cooperation with the inertial support system, elongating the rear structure and controlling the bending of the face, the pattern of bending of the face being a substantially bridge-like pattern of bending or a substantially modified bridge-like pattern of bending.

11 Claims, 13 Drawing Sheets

U.S. PATENT DOCUMENTS

| | | | | |
|---|---|---|---|---|
| 5,505,453 | A | 4/1996 | Mack | 273/186.2 |
| 5,529,543 | A * | 6/1996 | Beaumont, Sr. | 473/290 |
| 5,570,886 | A | 11/1996 | Rigal et al. | |
| 5,669,829 | A * | 9/1997 | Lin | 473/346 |
| 5,690,879 | A | 11/1997 | Lee | 264/237 |
| 5,711,722 | A | 1/1998 | Miyajima et al. | 473/346 |
| 5,766,093 | A * | 6/1998 | Rohrer | 473/329 |
| 5,807,190 | A | 9/1998 | Krumme et al. | |
| 5,830,084 | A | 11/1998 | Kosmatka | 473/349 |
| 5,839,975 | A | 11/1998 | Lundberg | 473/346 |
| 5,863,261 | A | 1/1999 | Eggiman | 473/329 |
| 5,873,793 | A | 2/1999 | Swinford | |
| 5,911,637 | A * | 6/1999 | Yamagata | 473/333 |
| 5,954,596 | A | 9/1999 | Noble et al. | 473/346 |
| 5,971,868 | A | 10/1999 | Kosmatka | 473/349 |
| 6,001,030 | A * | 12/1999 | Delaney | 473/329 |
| 6,017,280 | A | 1/2000 | Hubert | |
| 6,059,669 | A | 5/2000 | Pearce | 473/339 |
| 6,165,081 | A * | 12/2000 | Chou | 473/329 |
| 6,267,691 | B1 | 7/2001 | Dammen | 473/329 |
| 6,277,033 | B1 | 8/2001 | Krumme et al. | |
| 6,299,547 | B1 * | 10/2001 | Kosmatka | 473/329 |
| 6,302,807 | B1 * | 10/2001 | Rohrer | 473/329 |
| 6,309,311 | B1 | 10/2001 | Lu | |
| 6,319,150 | B1 | 11/2001 | Werner et al. | |
| 6,348,013 | B1 * | 2/2002 | Kosmatka | 473/329 |
| 6,348,015 | B1 | 2/2002 | Kosmatka | 473/342 |
| 6,354,956 | B1 * | 3/2002 | Doong | 473/219 |
| 6,354,961 | B1 | 3/2002 | Allen | 473/329 |
| 6,431,997 | B1 * | 8/2002 | Rohrer | 473/324 |
| 6,558,271 | B1 | 5/2003 | Beach et al. | 473/327 |
| 6,595,057 | B2 | 7/2003 | Bissonnette et al. | 73/579 |
| 6,595,870 | B2 * | 7/2003 | Stites et al. | 473/334 |
| 6,607,451 | B2 * | 8/2003 | Kosmatka et al. | 473/329 |
| 6,623,377 | B2 | 9/2003 | Evans et al. | 473/342 |
| 6,695,715 | B1 * | 2/2004 | Chikaraishi | 473/329 |
| 6,837,094 | B2 | 1/2005 | Pringle et al. | |
| 6,958,019 | B2 | 10/2005 | Rohrer | |
| 6,997,820 | B2 | 2/2006 | Willett et al. | |
| 7,077,758 | B2 | 7/2006 | Rohrer | |
| 7,192,365 | B2 * | 3/2007 | Souza et al. | 473/329 |
| 7,211,006 | B2 * | 5/2007 | Chang | 473/329 |
| 7,247,103 | B2 | 7/2007 | Beach et al. | |
| 7,261,642 | B2 * | 8/2007 | Blankenship | 473/326 |
| 7,261,645 | B2 | 8/2007 | Oyama | |
| 7,261,646 | B2 | 8/2007 | De Shiell et al. | |
| 7,273,420 | B2 * | 9/2007 | Wright | 473/329 |
| 7,396,295 | B1 | 7/2008 | Frame et al. | |
| 7,407,443 | B2 | 8/2008 | Franklin et al. | |
| 7,422,528 | B2 * | 9/2008 | Gibbs et al. | 473/329 |
| 7,497,789 | B2 * | 3/2009 | Burnett et al. | 473/342 |
| 7,674,186 | B2 * | 3/2010 | Bitko et al. | 473/329 |
| 2003/0228925 | A1 | 12/2003 | Rohrer | 473/251 |
| 2005/0153792 | A1 * | 7/2005 | Iacullo | 473/340 |
| 2006/0052177 | A1 * | 3/2006 | Nakahara et al. | 473/329 |
| 2006/0148589 | A1 * | 7/2006 | Liou | 473/350 |

FOREIGN PATENT DOCUMENTS

| | | |
|---|---|---|
| WO | WO 97/20940 | 7/1997 |
| WO | WO 98/20940 | 5/1998 |
| WO | WO 00/03768 | 1/2000 |
| WO | WO 00/27484 | 5/2000 |
| WO | WO 00/45904 | 8/2000 |
| WO | WO 01/83049 | 8/2001 |
| WO | WO 2004/098728 | 11/2004 |

OTHER PUBLICATIONS

W.S. Hemp, "Theory of Structural Design," *The College of Aeronautics Cranfield*, Report No. 115, Aug. 1958.

A.S.L. Chan, "The Design of Michell Optimum Structures," *College of Aeronautics Cranfield*, Report No. 142, Dec. 1960.

W. Johnson, "An Analogy Between Upper-Bound Solutions for Plane-Strain Metal Working and Minimum-Weight Two-Dimensional Frames," *International Journal of Mechanical Sciences*, vol. 3, 1961, pp. 239-246.

G.A. Hegemier and W. Prager, "On Michell Trusses," *International Journal of Mechanical Sciences*, vol. 11, 1969, pp. 209- 215.

W. Kozlowski and Z. Mroz, "Optimal Design of Disks Subject to Geometric Constraints," *International Journal of Mechanical Sciences*, vol. 12, 1970, pp. 1007-1021.

W. Johnson, et al., "The Displacement Field and its Signficance for Certain Minimum Weight Two-Dimensional Frames Using the Analogy with Perfectly Plastic Flow in Metal Working," *International Journal of Mechanical Sciences*, Vo. 13, 1971, pp. 547-561.

P. Dewhurst, "A General Matrix Operator for Linear Boundary Value Problems in Slip-Line Field Theory," *International Journal for Numerical Methods in Engineering*, vol. 21, 1985, pp. 169-182.

S. Srithongchai, "Computer-Aided Design and Manufacture of Minimum-Weight Structures," University of Rhode Island Dissertation, 2001.

P. Dewhurst, Analytical Solutions and Numerical Procedures for Minimum-Weight Michell Structures, *Journal of the Mechanics and Physics of Solids*, vol. 49, Mar. 2001, pp. 445-467.

G. Michal and M. Novak, "Materials in Sports: Designing for Ball Impacts," *Advanced Materials & Processes*, vol. 160, Sep. 2001, pp. 31-35.

A. Penner, "The Physics of Golf: The Convex Face of a Driver," *American Journal of Physics*, vol. 69, Oct. 2001, pp. 1073-1081.

P. Dewhurst and Stucker, "A Methodology for the Design of Optimum Structure," NSF Award, University of Rhode Island, Jul. 2002.

P. Dewhurst "Analysis and Design of a Minimum-Weight Beam Structure," NSF Conference Paper, University of Rhode Island, Jan. 2003.

S. Srithongchai, et al., "A Theoretical and Experimental Investigation of a Family of Minimum-Weight Simply-Supported Beams," *International Journal of Mechanical Sciences*, vol. 45, 2003, pp. 37-55.

P. Dewhurst, et al., "The Design of Minimum-Weight Product Structures: A Preliminary Case Study Combining Theoretical Optimum Layout Analysis with FEM Studies," Abaqus User's Conference, Munich, Jun. 2003.

P. Dewhurst, et al., "Issues of Instability and the use of Dual Materials in the Design of Minimum-Weight Structures," NSF Conference Paper, University of Rhode Island, Oct. 2003, pp. 1-14.

S. Srithongchai and P. Dewhurst, "Comparisons of Optimality Criteria for Minimum-Weight Dual Material Structures," *International Journal of Mechanical Sciences*, vol. 45, 2003, pp. 1781-1797.

P. Dewhurst, "A General Optimality Criterion for Strength and Stiffness of Dual-Material-Property Structures," *International Journal of Mechanical Sciences*, vol. 47, 2005, pp. 293-302.

A. Nair, et al., "Evolutionary Techniques for Identifying Minimum Weight Topologies and for the Suppression of Global Instabilities," ABAQUS Users' Conference, 2005.

P. Dewhurst and S. Srithongchai, "An Investigation of Minimum-Weight Dual-Material Symmetrically Loaded Wheels and Torsion Arms," *Journal of Applied Mechanics*, vol. 72, Mar. 2004, pp. 196-202.

PCT/US 03/11085, Feb. 9, 2004, International Search Report.

PCT/US2004/023368, Apr. 20, 2005, International Search Report and Written Opinion.

Arakawa, K. et al. "Dynamic Contact Behavior of a Golf Ball during an Oblique Impact", Experimental Mechanic, (2006) 691-697, 46.

McPhee et al., "Effect of sidespin and wind on projectile trajectory, with particular application to golf", Am. J.. Phys. 56 (10), Oct. 1988 pp. 933-939.

Erlichson, H., "Maximum projectile range with drag and lift, with particular application to golf," Am. J. Phys. 51 (4), Apr. 1983 pp. 357-362.

Williams, D., "Drag Force on a Golf Ball in Flight and its Practical Significance," Quart. Journ. Mech. and Applied Math (1959) pp. 387-392.

MacDonald, et al, "The Physics of the drive in golf," Am. J. Phys. 59 (3), Mar. 1991 pp. 213-218.

Penner, A., "The physics of golf: The optimum loft of a driver," Am. J. Phys. 69(5), May 2001, pp. 563-568.
Penner, A. "The Physics of Putting", Am. J.. Phy. 80, Feb. 2002, pp. 83-96.
Penner, A., The Run of a Golf Ball, Am J. Phy. 80, Jul. 2002, pp. 931-940.

* cited by examiner

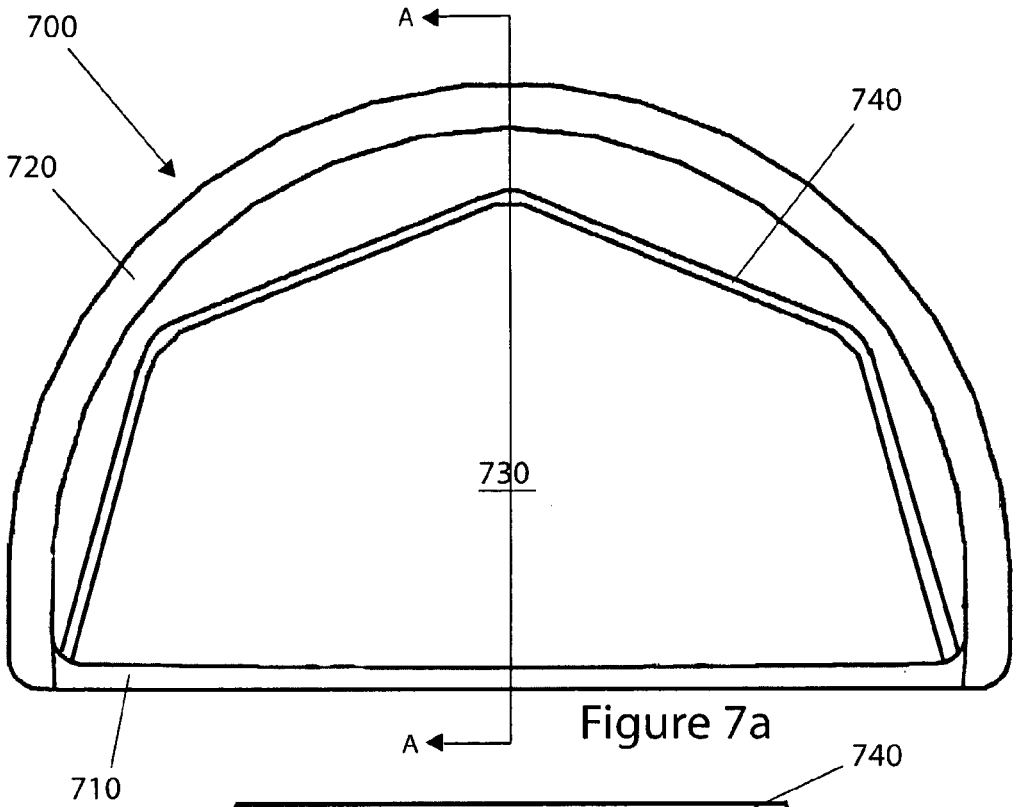
Figure 7a
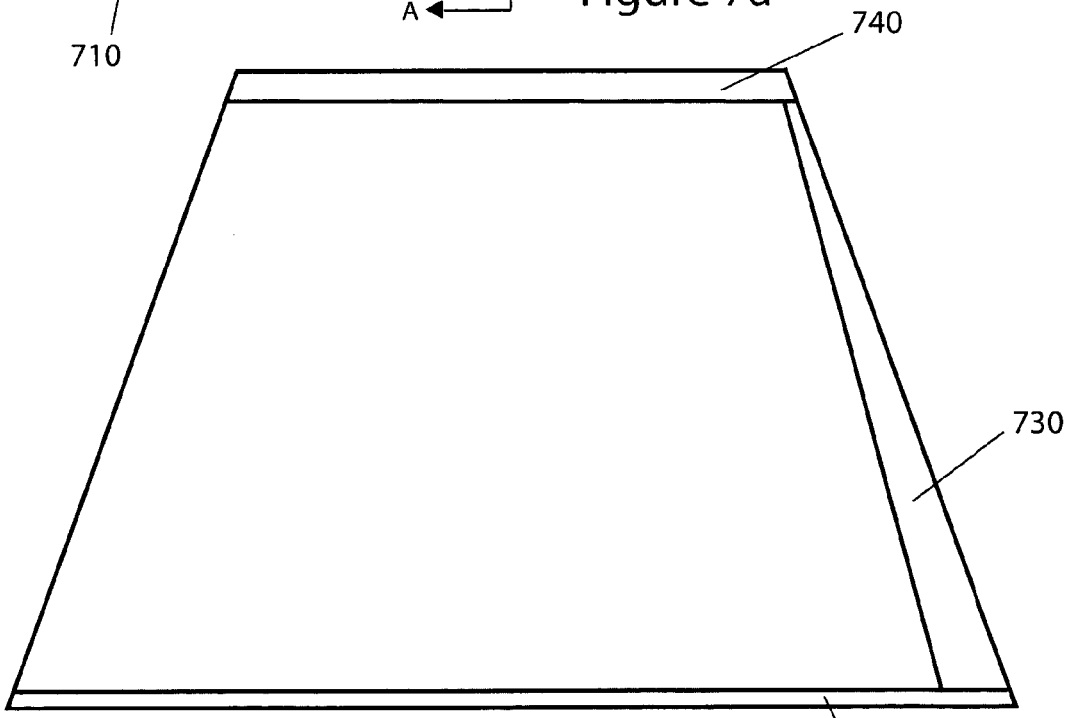
Figure 7b (on Section AA)

Figure 11a
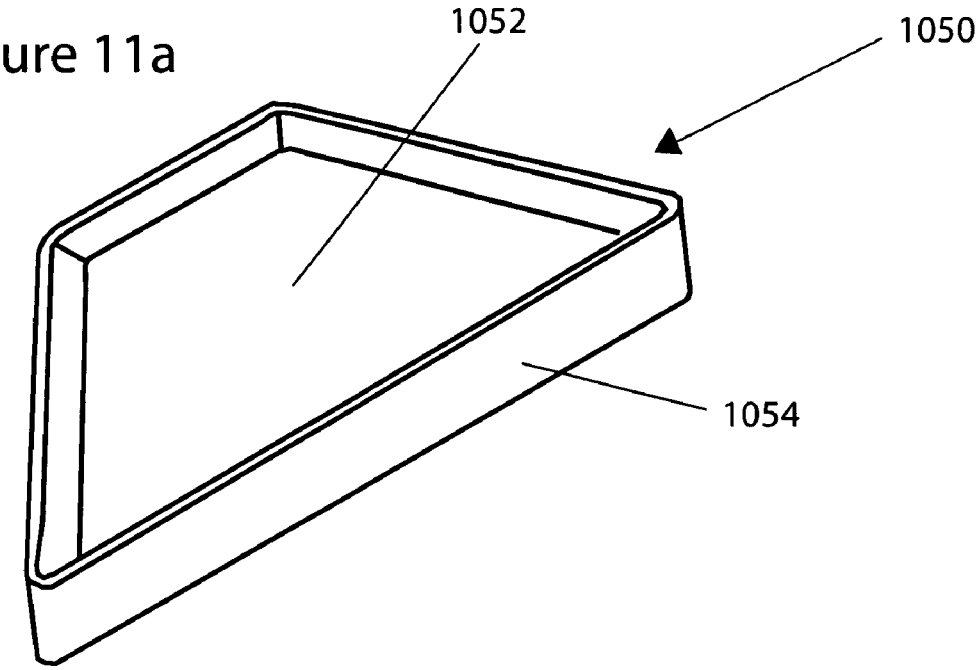
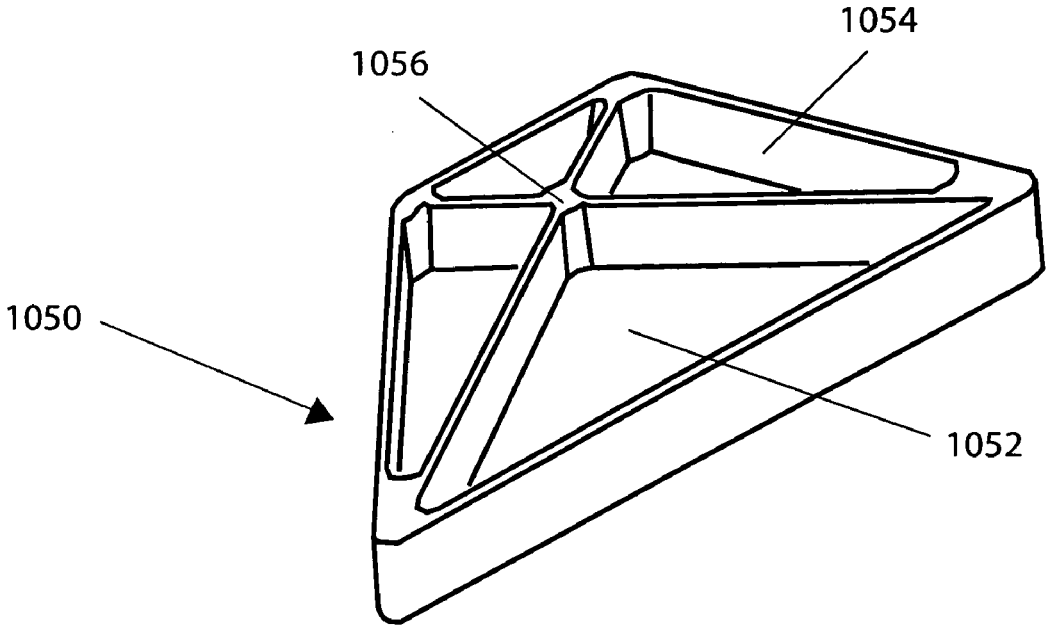
Figure 11b

Comparison Deflections of
Diaphragm and Modified Bridge Golf Club Heads
at Deflection Points J and K

GOLF CLUB HEAD

RELATED APPLICATIONS

This application is a continuation of PCT/US2004/023368 filed on Jul. 22, 2004, and a continuation-in-part of PCT/US2003/11085 filed on Apr. 11, 2003, the disclosures of which, in their entireties, are incorporated herein by reference.

TECHNICAL FIELD AND BACKGROUND ART

The present invention relates to golf club heads and, more particularly, to the design of golf club heads.

In general, golf club heads are designed as either solid bodies (for example, persimmons), plates (for example, irons and putters with perimeter weights), or shells with a diaphragm face (for example, metal drivers and fairway woods). Today, the general consensus is that a shell with a diaphragm face provides the optimal design solution for a golf club head, with incremental improvements on that design helping to improve how far and how accurately a golfer can hit the golf ball.

For example, as discussed in U.S. Pat. No. 6,348,015, the face of a "shell" golf club head is designed from a material having a natural frequency between 2800 Hz and 4500 Hz. Upon hitting the material, the golf ball undergoes smaller deformations and, hence, lower energy losses. Or, as discussed in U.S. Pat. No. 6,348,013, a "shell" golf club head is designed with one or more recesses in one or more of the head's walls. The recesses increase the amount of time the face of the head remains in contact with the ball, again reducing energy loss.

Similarly, in U.S. Pat. No. 6,267,691, the face of a "shell" golf club is reinforced with parallel ribs along the back side of the face, controlling how the face bends under impact load. The ribs help resist bending of the face in a direction parallel to the ribs, but permit bending of the face in a direction perpendicular to the ribs. The reinforcing ribs help dampen the head's vibrations and give the face a larger region in which there is an efficient transfer of energy from the face to the ball (known as the "sweet spot").

SUMMARY OF THE INVENTION

In accordance with one aspect of the invention, a golf club head comprises a face, an inertial support system, a rear structure, and a force transfer system. Under impact load, the force transfer system elongates the rear structure and controls, in cooperation with the inertial support system, the bending of the face, the pattern of bending of the face being a substantially bridge-like, or substantially modified bridge-like, pattern of bending.

In a further embodiment of the invention, the rear structure cooperates with the force transfer system and the inertial support system in controlling the bending of the face, the pattern of bending of the face being a substantially bridge-like, or a substantially modified bridge-like, pattern of bending. In another further embodiment of the invention, during an off-center impact load, a part of the face moves forward relative to the inertial support system. In an additional embodiment of the invention, the force transfer system and the rear structure control the forward movement of the face.

In still another embodiment of the invention, the golf club head further comprises a torsion control system, which is operatively connected to the inertial support system. The torsion control system may comprise a cross-brace, an insert, some combination of a cross-brace and an insert, or some combination of a cross-brace and a portion of an insert. The insert may have a wall thickness that is constant, multiple, varying or profiled. In addition, the torsion control system may be re-configurable or replaceable.

In alternate embodiments of the invention, the inertial support system may include a hosel, and the mass of the inertial support system may be at least equal to the combined mass of the face, the force transfer system and the rear structure. Also, the inertial support system, the force transfer system, the face, the rear structure or the torsion control system may each be an integral unit, or some combination of the inertial support system, the force transfer system, the face, the rear structure or the torsion control system may be an integral unit. In addition, the force transfer system may be separated into one or more portions.

In further embodiments of the invention, the force transfer system may be the crown of the golf club head, the sole of the golf club head, or a combination of the crown and sole of the golf club head. Or, a part of the force transfer system may be the crown of the golf club head, the sole of the golf club head, or a combination of the crown and sole of the golf club head. In addition, the golf club head may include a conventional crown or a conventional sole. The conventional crown or conventional sole may be composed of a thermoset elastomer, a thermoplastic elastomer, or an engineering plastic. The thermoset elastomer, thermoplastic elastomer, or engineering plastic may be combined with fillers or fibers, such as glass or carbon, to form a composite structure. Also, the conventional crown or conventional sole may be transparent (in whole or in part) or translucent (in whole or in part).

In accordance with another aspect of the invention, a golf club head comprises a face and a substantially non-deforming mass connected to the face. Under impact load, the contact forces from the impact load, in connection with the resulting inertial reaction forces from the substantially non-deforming mass produce a pattern of bending of the face that is a substantially bridge-like, or substantially modified bridge-like, pattern of bending.

In accordance with still another aspect of the invention, a golf club head comprises a face, an inertial support system, a rear structure, and a force transfer system. Under on-center impact load, the force transfer system may be placed in a state of substantially pure axial compression.

In a further embodiment of the invention, the rear structure may be placed in a state of substantially pure axial tension under on-center impact load.

In accordance with a further aspect of the invention, a golf club head designed to act under impact load as a bridge comprises a face, the face acting as a bridge span; an inertial support system, the inertial support system acting as a bridge support; a rear structure and a force transfer system, the force transfer system and the rear structure acting together as a bridge truss.

BRIEF DESCRIPTION OF THE DRAWINGS

The foregoing features of the invention will be more readily understood by reference to the following detailed description, taken with reference to the accompanying drawings, in which:

FIG. 7*a* is a schematic top view, and FIG. 7*b* is a sectional view, of an exemplary embodiment of a golf club head designed to act, under impact load, as a bridge.

FIG. 11*a* and FIG. 11*b* are schematic side views of an exemplary embodiment for a torsion control system used in a golf club head designed to act, under impact load, as a bridge.

DETAILED DESCRIPTION OF SPECIFIC EMBODIMENTS

In accordance with one embodiment of the invention, a golf club head is designed to act as a "bridge" when the golf club head impacts a golf ball during game play (referred to hereinafter as "under impact load"). In general, the face of the golf club head corresponds to the bridge span, with the bridge truss and the bridge inertial supports located behind the face. As such, the bridge-like golf club head designs described herein are minimum weight structures that are inertially-supported under dynamic loading.

For ease of reference, the term "bridge" is used herein to refer to both a bridge structure and a modified bridge structure. In a bridge structure, most, if not all, of the characteristics of the structure are similar to the characteristics of a bridge—with few, if any, of the characteristics of other structures, such as a solid body, a plate, or a shell with a diaphragm face. In a modified bridge structure, some, but not all, of the characteristics of the structure are similar to the characteristics of a bridge—with additional characteristics of other structures, such as a solid body, a plate, or a shell with a diaphragm face.

In general, a golf club head designed to act, under impact load, as a bridge may have a sweet spot that extends across the height of the face of the golf club head and a center of mass that may be closer to the face of the golf club head. The bridge truss, located behind the face, may be tailored to provide a particular rate of deflection under impact load, and the bridge inertial supports may be tailored to provide a particular moment of inertia. Furthermore, the mass of the golf club head needed to support the impact load may be less than the mass needed in a "shell" golf club head. This leaves more mass available to optimize the inertial performance of the golf club head.

Figure 1:
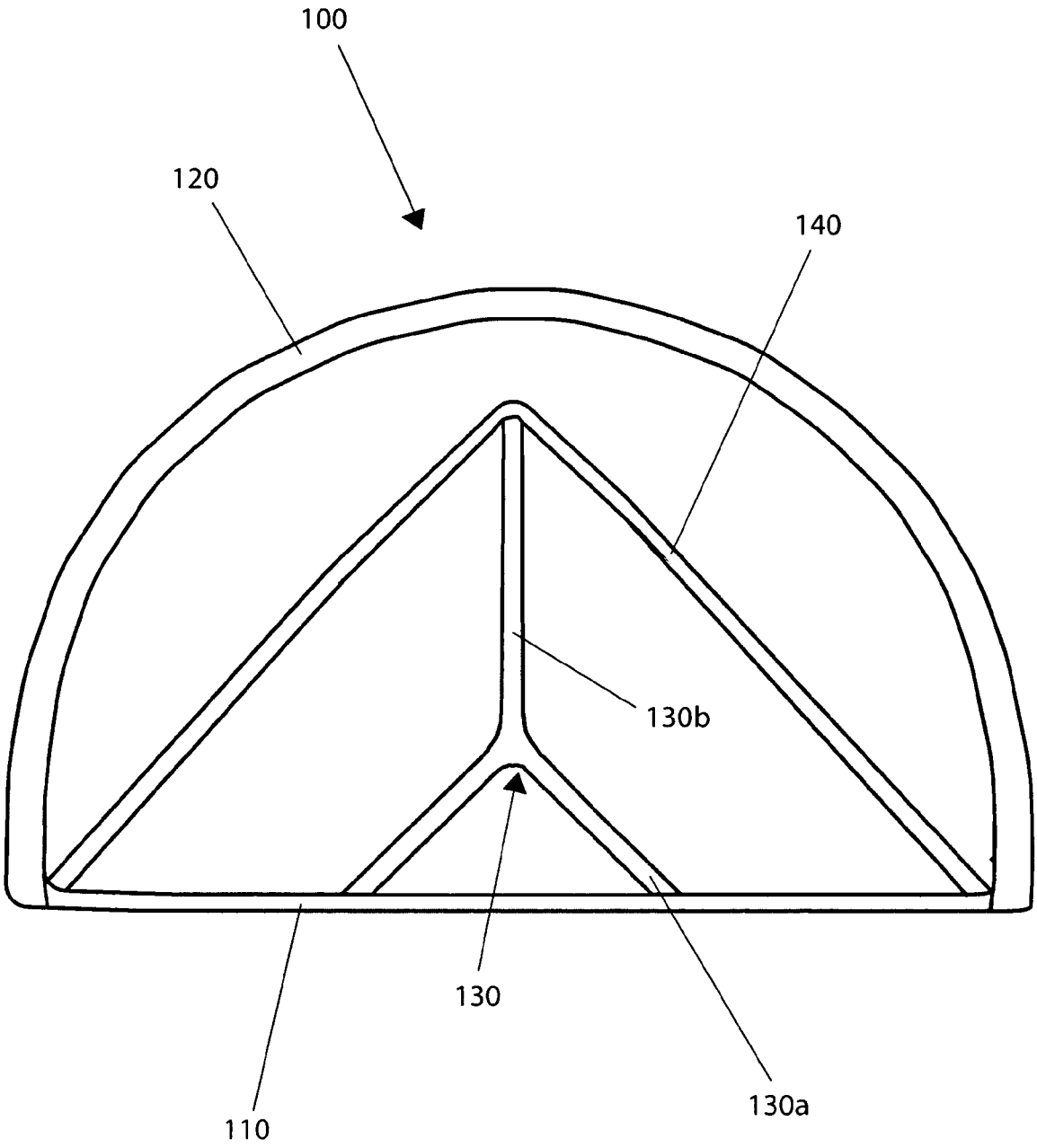
FIG. 1 is a schematic top view of an exemplary embodiment of a golf club head designed to act, under impact load, as a bridge.

FIG. 1 is a schematic of an exemplary embodiment of a golf club head designed to act, under impact load, as a bridge. In golf club head 100, face 110 is connected to inertial support system 120 and force transfer system 130. In turn, rear structure 140 is connected to force transfer system 130 and face 110. Force transfer system 130 comprises two component parts, inner structure 130*a* and radial structure 130*b*.

For ease of reference, the term "connection" is used herein to refer to physical connections between structures, as well as operational connections between structures. For example, the statement that structure A is connected to structure B may mean: (1) structure A is physically attached to structure B; (2) structure A interacts with structure B under operational conditions; or (3) structure A is physically attached to structure B and structure A interacts with structure B under operational conditions.

Inertial support system 120, connected to the left side edge and right side edge of face 110, provides support for the "bridge structure" of golf club head 100. The bridge structure is that part of golf club head 100 required to support the impact load of a golf ball—face 110, force transfer system 130 and rear structure 140. Under impact load, the bridge structure transfers load to inertial support system 120.

Under an off-center impact load, inertial support system 120 also opposes the "rotation" of golf club head 100 resulting from the off-center impact load. For example, when a golf club head hits a golf ball somewhere between the center of the face and the toe of the golf club head, the golf club head will rotate about a vertical axis. In turn, the golf ball will travel in an unintended direction. With opposition, such as that provided with inertial support system 120, the rotation of the golf club head is reduced. In other words, inertial support system 120 produces high moments of inertia for golf club head 100.

In general, under impact load, force transfer system 130, in connection with inertial support system 120, elongates rear structure 140, controls the "bending" of face 110 (and thus the deflection of face 110), and controls the rate of deflection of face 110. For example, force transfer system 130 and inertial support system 120 may control the rate of deflection of face 110 at the same rate of deflection of a golf ball hit at a particular swing velocity, thereby achieving a good dynamic response and an impedance match between face 110 and the golf ball. In golfer parlance, a good impedance match means a good driving distance for the golf ball. In an alternate embodiment of golf club head 100, rear structure 140 may also, in connection with force transfer system 130 and inertial support system 120, control the bending of face 110 and control the rate of deflection of face 110.

In addition, under an on-center impact load, with force transfer system 130 and rear structure 140 acting substantially in the manner of a bridge truss, force transfer system 130 and rear structure 140 are placed in a state of either substantial axial compression or substantial axial tension. In particular, inner structure 130a and radial structure 130b are placed in a state of substantial axial compression (a "push" along the length of a structure) and rear structure 140 is placed in a state of substantial axial tension (a "pull" along the length of a structure).

Figure 12A:
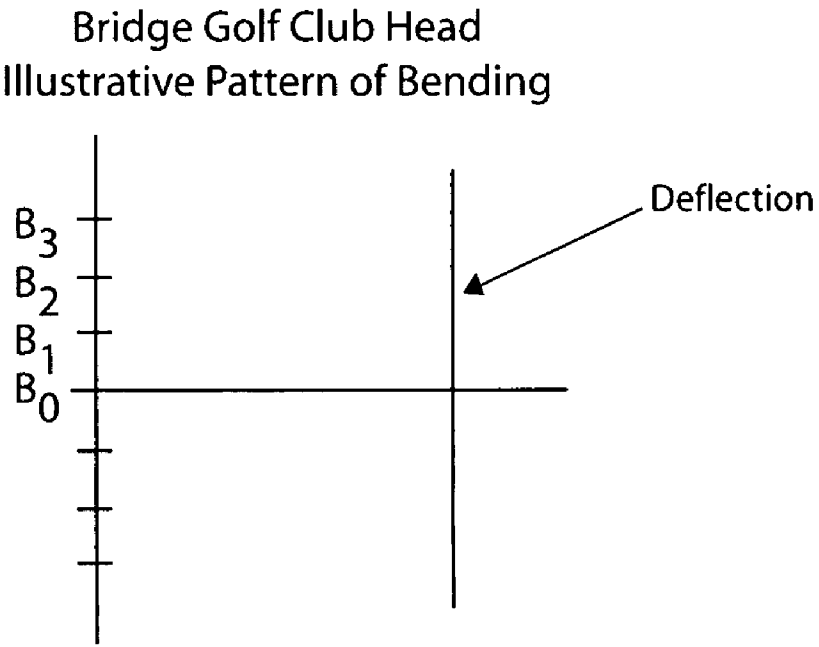
FIG. 12*a* and FIG. 12*b* are graphs showing the pattern of bending in golf club heads according to embodiments of the invention in comparison to diaphragm golf club heads.
Figure 12A:
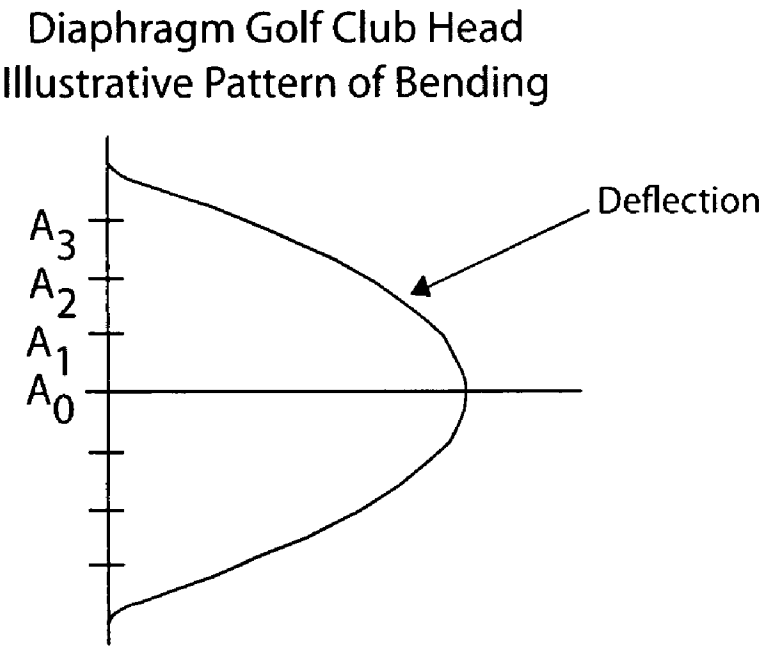

Under all impact loads, on-center and off-center, face 110 bends under the impact. As shown in FIG. 12*a*, however, the pattern of bending differs from the pattern of bending seen in the face of a "drum" golf club head. In a drum golf club head, also referred to herein as a diaphragm golf club head, the pattern of bending of the face as measured along a vertical line (in relation to the horizon) from the top edge of the face to the bottom edge of the face is not uniform. In other words, along a vertical line $A_0$ to $A_{10}$, the rearward deflection of $A_0$ may not equal the rearward deflection of $A_1$, the rearward deflection of $A_1$ may not equal the rearward deflection of $A_2$, the rearward deflection of $A_2$ may not equal the rearward deflection of $A_3$, etc. The reason for the non-uniform bending is inherent in the diaphragm golf club head's design, which requires rigid connections of the face along its top, bottom and side edges.

In golf club head 100, the pattern of bending of face 110 is substantially uniform from the top edge of the face to the bottom edge of the face, as measured along a vertical line (in relation to the horizon) (hereinafter referred to as "bridge-like pattern of bending"). In other words, along a vertical line $B_0$ to $B_{10}$, the rearward deflection of $B_0$ is substantially equal to the rearward deflection of $B_1$, the rearward deflection of $B_1$ is substantially equal to the rearward deflection of $B_2$, the rearward deflection of $B_2$ is substantially equal to the rearward deflection of $B_3$, etc. Thus, in comparison to a diaphragm golf club head, which has a sweet "spot" (defined as a single point on the face of the diaphragm golf club head), face 110 has a sweet "line" (defined as a series of points on face 110 of golf club head 100). The "sweet" region on the face of a golf club head is, in part, the region optimized to have efficient transfer of energy from the face of the golf club head to the golf ball.

A person of skill in the art understands that the phrase "along a vertical line (in relation to the horizon)" is used for ease of reference. In operation, in many golf club heads, the vertical axis of the club face may not be perpendicular to the horizon. Instead, the vertical axis of the club face may be angled in relation to the horizon (for example, oriented in relation to a particular "hit" distribution). Thus, in such a club face, the bridge-like pattern of bending may occur along a line substantially parallel to the vertical axis of the club face. In addition, in many golf club heads, the face of the golf club head may not be planar (for example, the face may have a roll). In such a club face, the bridge-like pattern of bending may occur along a line substantially tangential to the curved face of the golf club head. In other words, a bridge-like pattern of bending is a pattern of bending of face 110 that is substantially uniform from near the top edge of face 110 to near the bottom edge of face 110, as measured along a vertical line (in relation to the horizon), as measured along a line substantially parallel to the vertical axis of face 110 (which may not be perpendicular to the horizon) or as measured along a line substantially tangential to a curve in face 110.

In an alternate embodiment of golf club head 100, the pattern of bending of face 110 is a "modified" bridge-like pattern of bending. In a modified bridge-like pattern of bending the maximum deflections (and rates of deflection) at various points of impact for various impacts, which occur over a substantial area of the face, have approximately the same value. In other words, in an area C of the face, the rearward deflection $Z_1$ from impact $I_1$ (which occurs at point $[X_1, Y_1]$ on the face) is substantially equal to the rearward deflection $Z_2$ from impact $I_2$ (which occurs at point $[X_2, Y_2]$ on the face), the rearward deflection $Z_2$ from impact $I_2$ is substantially equal to the rearward deflection $Z_3$ from impact $I_3$ (which occurs at point $[X_3, Y_3]$ on the face), the rearward deflection $Z_3$ from impact $I_3$ is substantially equal to the rearward deflection $Z_4$ of impact $I_4$ (which occurs at point $[X_4, Y_4]$ on the face), etc. Thus, despite the fact that impacts $I_1$, $I_2$, $I_3$ and $I_4$ are all at different points on face 110, the deflections from the impacts are substantially equal, such that $Z_1 \approx Z_2 \approx Z_3 \approx Z_4 \ldots \approx Z_n$. In addition, the rates of deflections from the impacts are also substantially equal, such that $\dot{Z}_1 \approx \dot{Z}_2 \approx \dot{Z}_3 \approx \dot{Z}_4 \ldots \approx Z_n$.

Figure 12B:
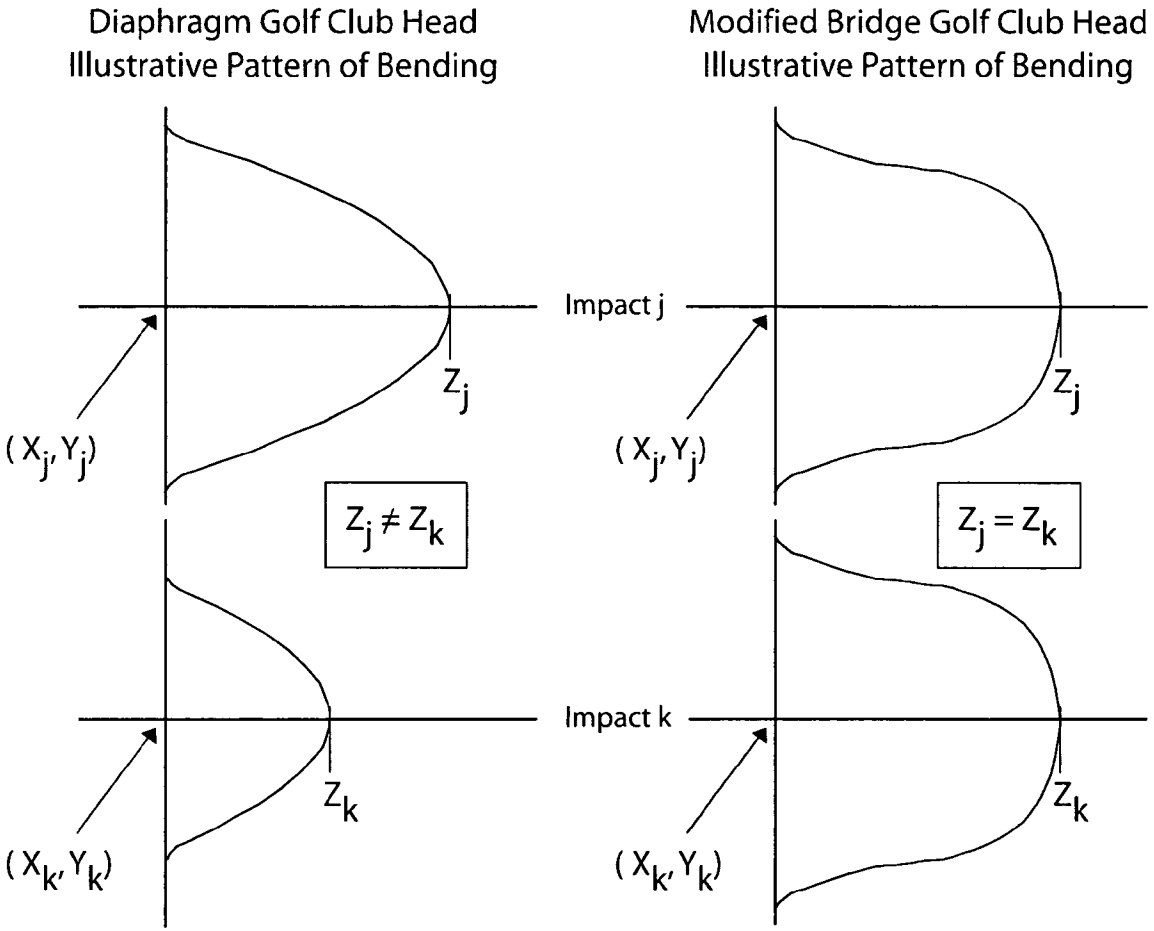

In contrast, as shown in FIG. 12*b*, in a diaphragm golf club head, the maximum deflections (and rates of deflection) at vari ous points of impact for various impacts, which occur over a substantial area of the face, do not have approximately the same value. In other words, in an area D on the face, the rearward deflection $Z_1$ from impact $I_1$ (which occurs at point $[X_1, Y_1]$ the face) is not substantially equal to the rearward deflection $Z_2$ from impact $I_2$ (which occurs at point $[X_2, Y_2]$ on the face), the rearward deflection $Z_2$ from impact $I_2$ is not substantially equal to the rearward deflection $Z_3$ from impact $I_3$ (which occurs at point $[X_3, Y_3]$ on the face), the rearward deflection $Z_3$ from impact $I_3$ is not substantially equal to the rearward deflection $Z_4$ of impact $I_4$ (which occurs at point $[X_4, Y_4]$ on the face), etc. Thus, in a diaphragm golf club head, the deflections from the impacts are not substantially equal, such that $Z_1 \approx Z_2 \approx Z_3 \approx Z_4 \ldots \approx Z_n$. In addition, the rates of deflection from the impacts are also not substantially equal, such that $\dot{Z}_1 \approx \dot{Z}_2 \approx \dot{Z}_3 \approx \dot{Z}_4 \ldots \approx \dot{Z}_n$.

In one embodiment of the invention, the "sweet" area of face 110 is more than approximately 25% of the area of face 110. In all embodiments for the sweet regions (both lines and areas) of face 110, the regions may be angled to better match the golf impact distribution for a particular golfer (or a group of golfers). For example, the sweet regions of face 110 may be angled at 30° from the horizontal.

As discussed, under an off-center impact load, face 110 bends with the bridge-like pattern of bending. In addition, during an off-center impact load, a part of face 110 moves forward relative to inertial support system 120. Typically, the part of face 110 that moves forward relative to inertial support system 120 is opposite from the side of face 110 impacted by the golf ball. It is believed that the forward movement of face 110 under an off-center impact load, which the force transfer system and the rear structure control, accounts for one of the great characteristics of a bridge-like golf club head-the ability to drive the golf ball in its intended direction even though the golfer hit the golf ball off the center line of face 110.

In an alternate embodiment of golf club head 100, face 110 includes a "hinged" portion (or portions) that flex(es), acting as a hinge. The hinged portion, typically located to the right side edge or left side edge of face 110, flexes under impact load. In other words, the hinged portion of face 110 rotates about the connection of face 110 and inertial support system 120.

In a further alternate embodiment of golf club head 100, the mass of inertial support system 120 is greater than, or equal to, the combined mass of face 110, force transfer system 130 and rear structure 140. Thus, in this alternate embodiment of golf club head 100, at least 50% of the mass of golf club head 100 may be used to optimize moment of inertia values for golf club head 100.

In still further alternate embodiments of golf club head 100, face 110 may not be physically connected to inertial support system 120 (see corresponding golf club elements in FIG. 5) or face 110 may not be physically connected to rear structure 140 (not shown). However, under impact load, these alternate embodiments of golf club head 100 react the same as golf club head 100. For example, inertial support system 120 provides support for the bridge structure of golf club head 100, receiving the load during impact and, under off-center impact loads, opposing rotation of golf club head 100. In addition, in connection with other systems, force transfer system 130 controls the bending of face 110 (and thus the deflection of face 110) and controls the rate of deflection of face 110.

Figure 2:
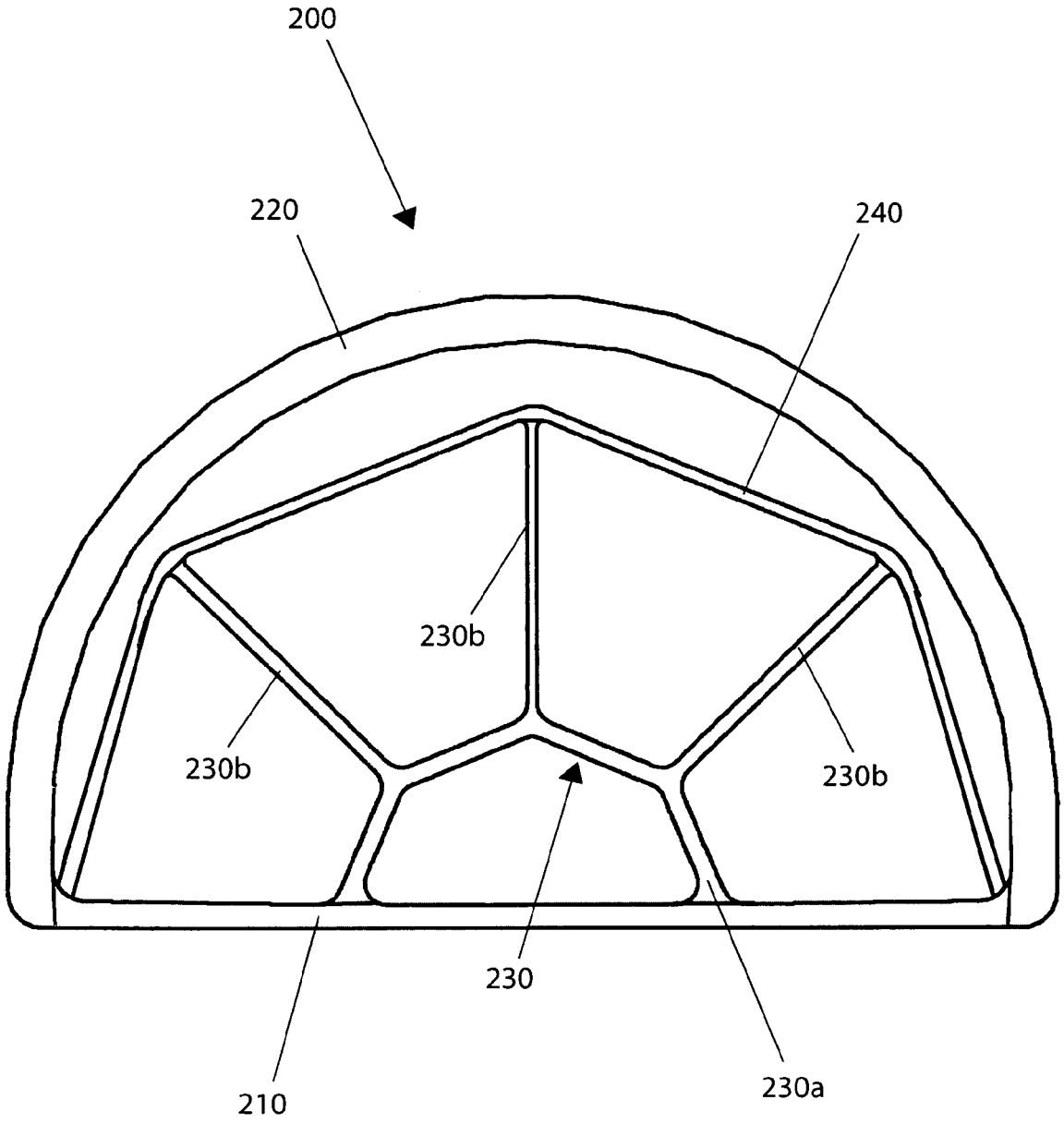
FIG. 2 is a schematic top view of an exemplary embodiment of a golf club head designed to act, under impact load, as a bridge.

FIG. 2 is a schematic of an exemplary embodiment of a golf club head designed to act, under impact load, as a bridge. In golf club head 200, force transfer system 230 comprises three radial structures, notated as 230*b*, rather than one radial structure. Under impact load, radial structures 230*b* react in the same manner as radial structure 130*b*. In other words, under an on-center impact load, radial structures 230*b* are each placed in a state of substantially pure axial compression, exhibiting minimal bending. While the disclosed exemplary embodiments describe a force transfer system with either one radial structure or three radial structures, the force transfer system may comprise any number of radial structures. For example, the force transfer system may appear to the naked eye to be a "solid" structure but, on a microscopic level, is comprised of some number of radial structures. A person of skill in the art understands that, as the number of radial structures increases, the more closely the force transfer system approximates a minimum weight structure.

Figure 3:
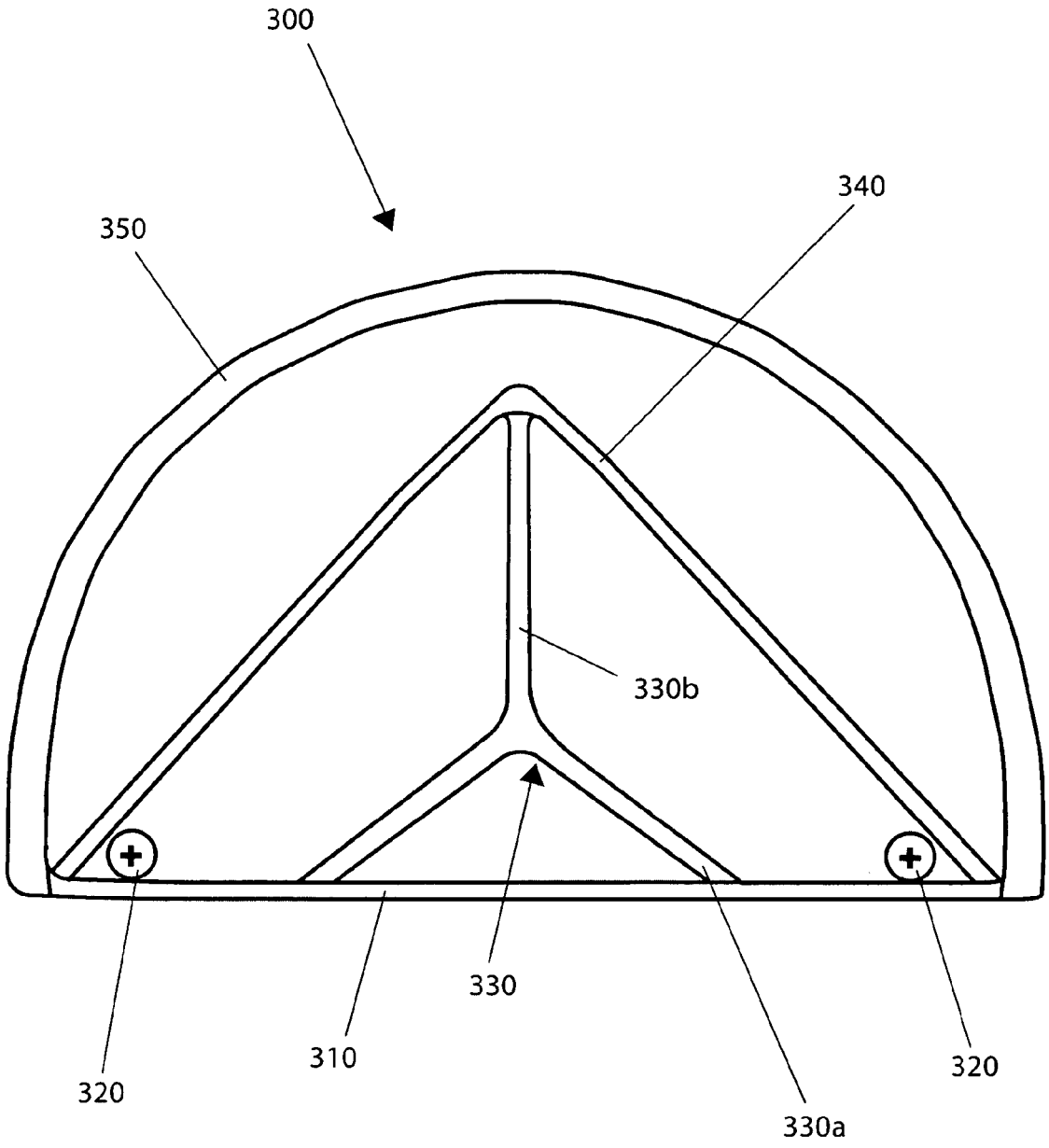
FIG. 3 is a schematic top view of an exemplary embodiment of a golf club head designed to act, under impact load, as a bridge.

FIG. 3 is a schematic of an exemplary embodiment of a golf club head designed to act, under impact load, as a bridge. In golf club head 300, face 310 is connected to inertial support system 320, force transfer system 330, and back 350. In turn, rear structure 340 is connected to force transfer system 330 and face 310. Force transfer system 330 comprises two component parts, inner structure 330*a* and radial structure 330*b*.

However, unlike the inertial support systems for golf club head 100 and 200, the inertial support system for golf club head 300 is a set of concentrated mass elements (hereinafter referred to as "posts"). Under impact load, inertial support system 320 reacts in the same manner as inertial support systems 120 and 220—providing support for the bridge structure of golf club head 300, receiving the load during impact and, under off-center impact loads, opposing rotation of golf club head 300.

In an alternate embodiment of golf club head 300, inertial support system 320 is comprised of a set of posts connected with one or more bars. The bars may connect the posts along any point, or points, on the posts. For example, the bars may connect just the top of the posts, just the bottom of the posts, just the center of the posts, or both the top and the bottom of the posts.

Figure 4:
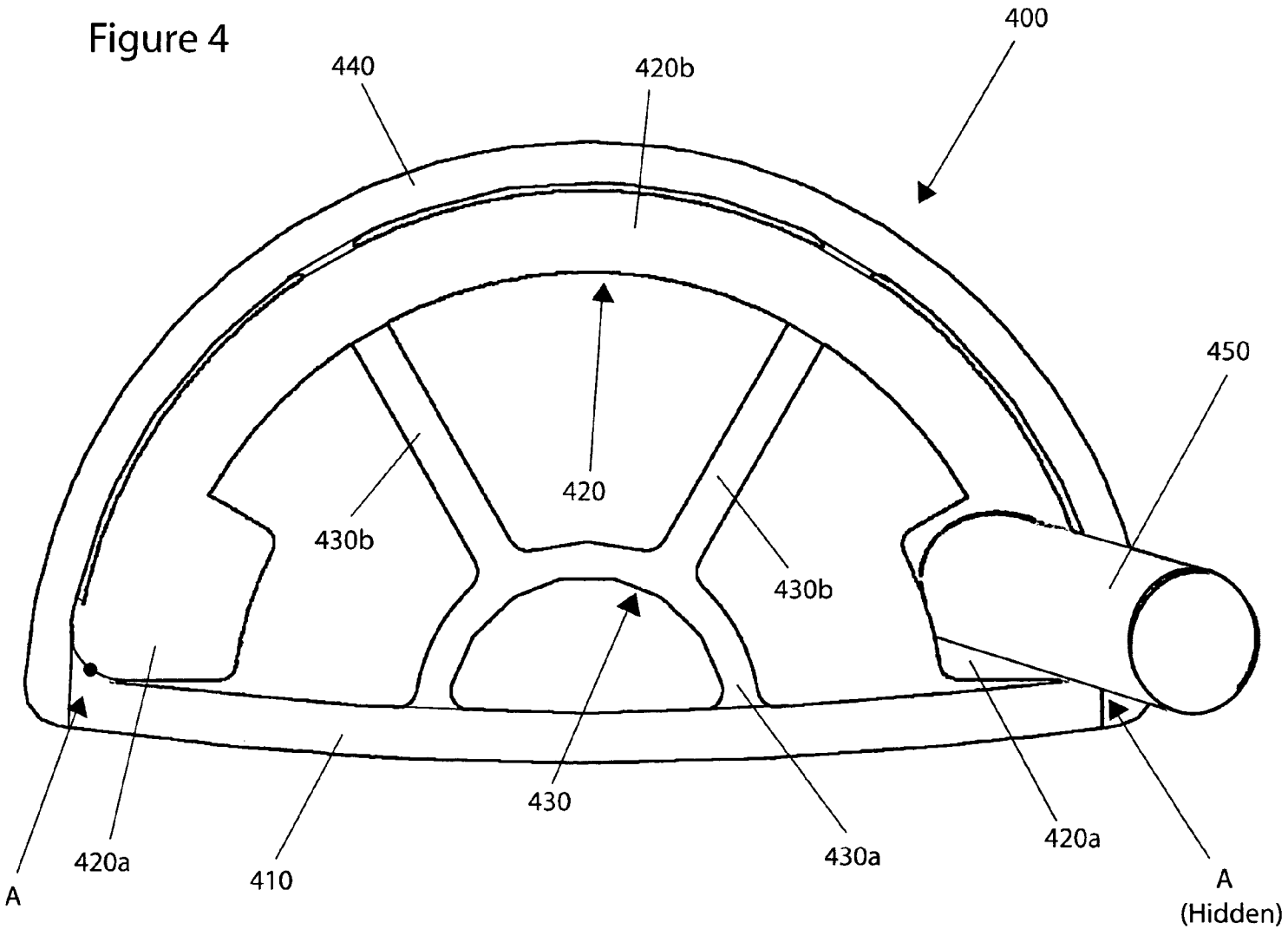
FIG. 4 is a schematic top view of an exemplary embodiment of a golf club head designed to act, under impact load, as a bridge.

FIG. 4 is a schematic of an exemplary embodiment of a golf club head designed to act, under impact load, as a bridge. In golf club head 400, face 410 is connected to inertial support system 420 (which includes hosel 450) and force transfer system 430. In turn, rear structure 440 is connected to force transfer system 430 and face 410. In this exemplary golf club head, the connection between face 410 and inertial support system 420 is line connection A, which is substantially perpendicular to the page. A line connection is a connection between two structures along a single set of points substantially forming a line. Force transfer system 430 comprises three component parts, inner structure 430*a* and radial structures 430*b*.

As shown in FIG. 4, inertial support system 420 is a set of posts, notated as 420*a*, connected with a curved bar, notated as 420*b*. Inertial support system 420 may straddle radial structures 430*b*, may rest on top of radial structures 430*b*, or may rest within radial structures 430*b*. Under impact load, inertial support system 420 reacts in the same manner as inertial support systems 120, 220 and 320—providing support for the bridge structure of golf club head 400, receiving the load during impact and, under off-center impact loads, opposing rotation of golf club head 400.

Figure 5:
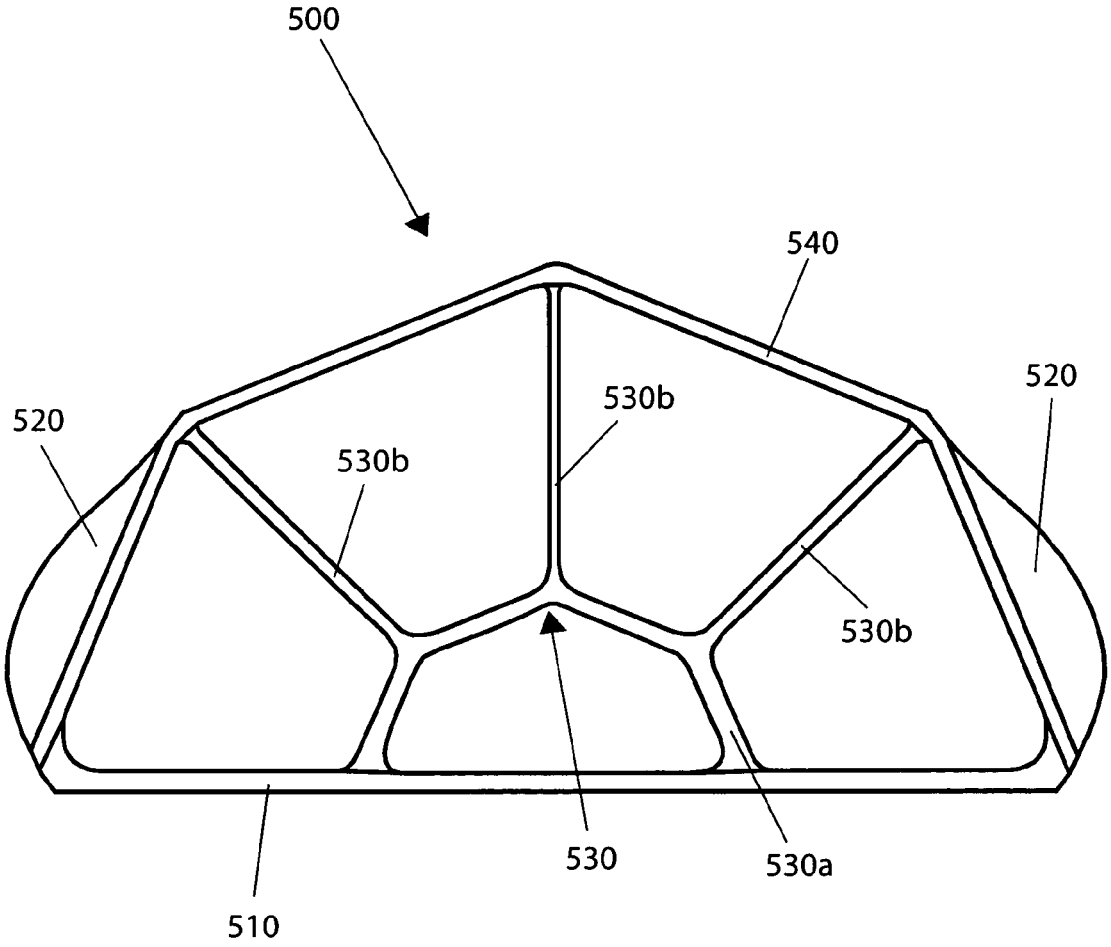
FIG. 5 is a schematic top view of an exemplary embodiment of a golf club head designed to act, under impact load, as a bridge.

FIG. 5 is a schematic of an exemplary embodiment of a golf club head designed to act, under impact load, as a bridge. As noted above, in FIG. 5, face 510 is not physically connected to inertial support system 520.

Figure 6:
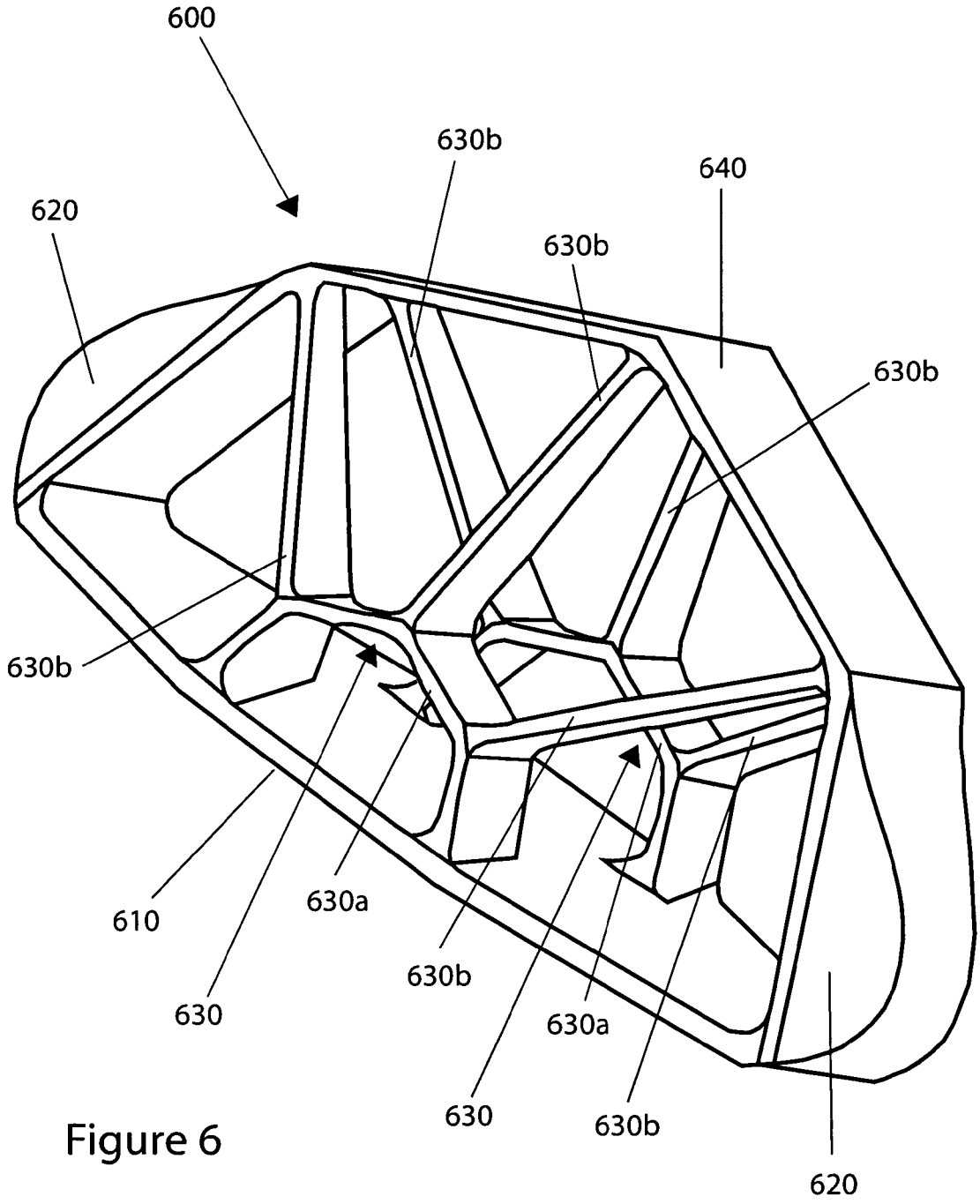
FIG. 6 is a schematic side view of an exemplary embodiment of a golf club head designed to act, under impact load, as a bridge.

FIG. 6 is a schematic of an exemplary embodiment of a golf club head designed to act, under impact load, as a bridge. Like golf club head 500, face 610 is connected to force transfer system 630 and rear structure 640, but is not physically connected to inertial support system 620. Force transfer system 630 comprises eight component parts, inner structures 630*a* and radial structures 630*b*.

In addition, force transfer system 630 is separated into a top portion and a bottom portion. The separation may occur at any point along the height of force transfer system 630, with the height of the top portion being equal to, less than, or greater than, the height of the bottom portion. Under impact load, golf club head 600 reacts the same as golf club heads 100 through 500. In particular, force transfer system 630 produces the same effect produced in force transfer systems 130 through 530—that is, in connection with inertial support system 620 (or, in an alternate embodiment, in connection with inertial support system 620 and rear structure 640), elongating rear structure 640, controlling the bending of face 610 (and thus the deflection of face 610), and controlling the rate of deflection of face 610.

In alternate embodiments of golf club head 600, force transfer system 630 may be separated into a left portion and a right portion. The separation may occur at any point along the length of force transfer system 630, with the length of the left portion being equal to, less than, or greater than, the length of the right portion. In addition, force transfer system 630 may be separated into more than two portions, with the height (or length) of each portion being equal to, less than, or greater than the height (or length) of any other portion. In addition, the separate portions of force transfer system 630 may not be "mirror images" of each other. In other words, the separate portions of force transfer system 630 may have different structures. For example, in a force transfer system with a top portion and a bottom portion, the top portion may be structured similar to force transfer system 430 (in FIG. 4) and the bottom portion may be structured similar to force transfer system 230 (in FIG. 2). Also, the separate portions of force transfer system 630 may be "misaligned" with one or more of the separate portions in a different plane than one or more of the other portions.

FIGS. 7*a* and 7*b* are schematics of an exemplary embodiment of a golf club head designed to act, under impact load, as a bridge. In golf club head 700, face 710 connects to inertial support system 720 and force transfer system 730. In turn, rear structure 740 is connected to force transfer system 730 and face 710.

Unlike force transfer systems 130 through 630, force transfer system 730 comprises the crown of golf club head 700. In particular, force transfer system 730 is a crown of varying thickness that acts as part of the bridge structure. For example, as shown in FIG. 7*b*, force transfer system 730 may have a single region, in which the thickness varies from the front of the region to the back of the region. Or, force transfer system 730 may have more than one region, in which the thickness of each region varies in the same manner or in different manners. For example, in each region the thickness may vary from the front of each region to the back of each region. Or, in a first region, the thickness may vary from the front of that region to the back of that region, in a second region, the thickness may vary from the center of that region to the edges of that region, etc. Under impact load, force transfer system 730 produces the same effect produced in force transfer systems 130 through 630-that is, in connection with inertial support system 720 (or, in an alternate embodiment, in connection with inertial support system 720 and rear structure 740), elongating rear structure 740, controlling the bending of face 710 (and thus the deflection of face 710), and controlling the rate of deflection of face 710.

In an alternate embodiment of golf club head 700, force transfer system 730 comprises the sole of golf club head 700. In another alternate embodiment of golf club head 700, force transfer system 730 comprises both the crown and the sole of golf club head 700.

In another alternate embodiment of golf club head 700, force transfer system 730 may comprise a part of the crown of golf club head 700, the remaining part of force transfer system configured in a manner similar to the force transfer systems shown in FIGS. 1-6. Or, force transfer system 730 may comprise a part of the sole of golf club head 700, the remaining part of force transfer system configured in a manner similar to the force transfer systems shown in FIGS. 1-6. Likewise, force transfer system 730 may comprise a part of the crown and a part of the sole of golf club head 700, the remaining part of force transfer system configured in a manner similar to the force transfer systems shown in FIGS. 1-6.

Figure 8:
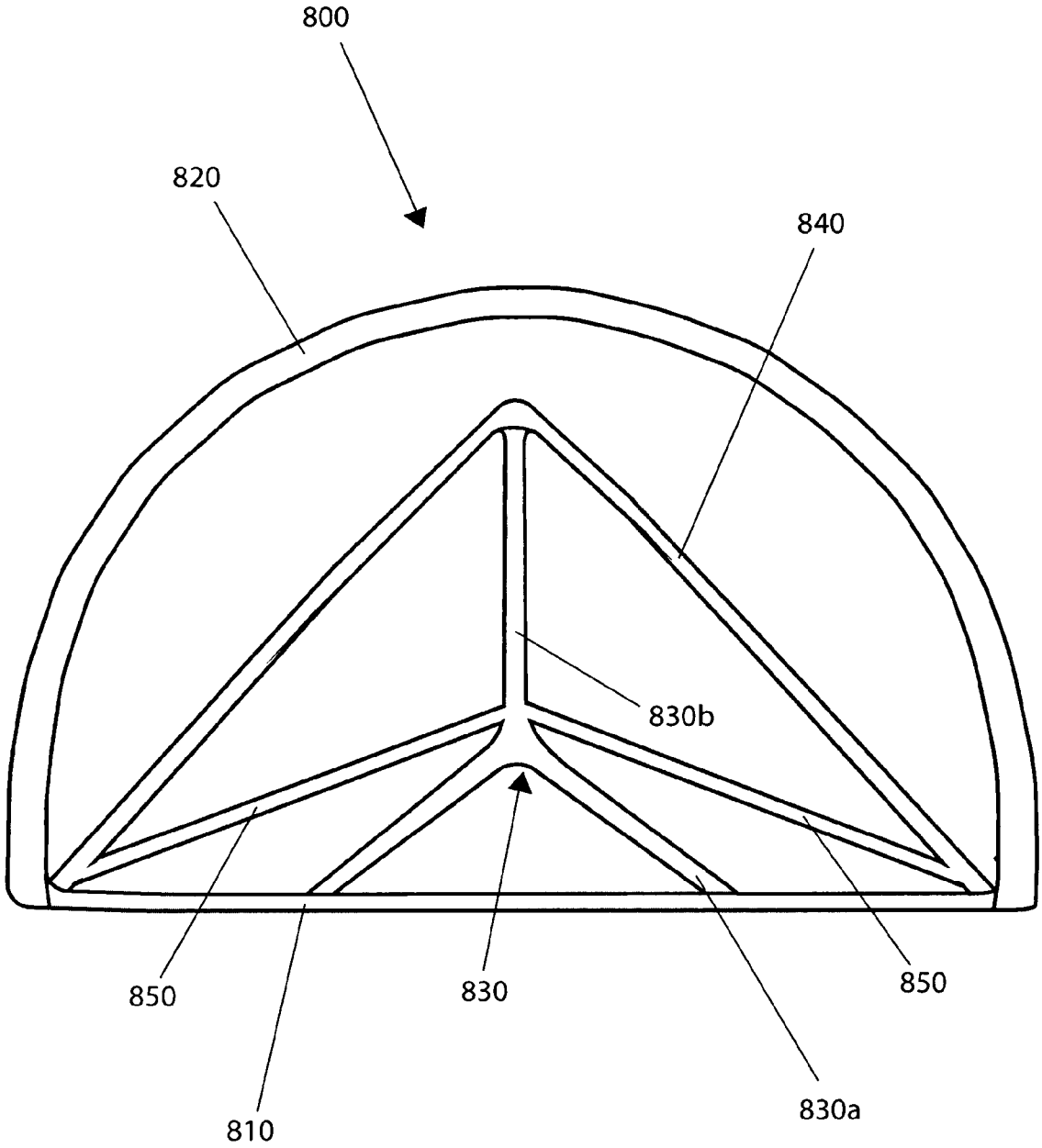
FIG. 8 is a schematic top view of an exemplary embodiment of a golf club head with an exemplary embodiment of a torsion control system, the golf club head designed to act, under impact load, as a bridge.

FIG. 8 is a schematic of an exemplary embodiment of a golf club head designed to act, under impact load, as a bridge. In golf club head 800 (which is similar in structure to golf club head 100), a torsion control system, identified as cross-brace 850, is connected to rear structure 840 and force transfer system 830. Under off-center impact load, cross-brace 850 provides torsional resistance to force transfer system 830. In other words, in connection with inertial support system 820, cross-brace 850 opposes the internal "rotation" (relative to inertial support system 820) of force transfer system 830 resulting from an off-center impact load. In addition, in an off-center impact load, approximately one-half (left side or right side) of cross-brace 850 is placed in a state of substantially pure axial compression and approximately one-half (right side or left side) is placed in a state of substantially pure axial tension.

In an alternate embodiment of golf club head 800, the mass of inertial support system 820 is no less than 30% of the combined mass of face 810, force transfer system 830, rear structure 840 and torsion control system 850. Thus, in this alternate embodiment of golf club head 800, a large portion of the mass of golf club head 800 may be used to optimize moment of inertia values for golf club head 800.

Figure 9:
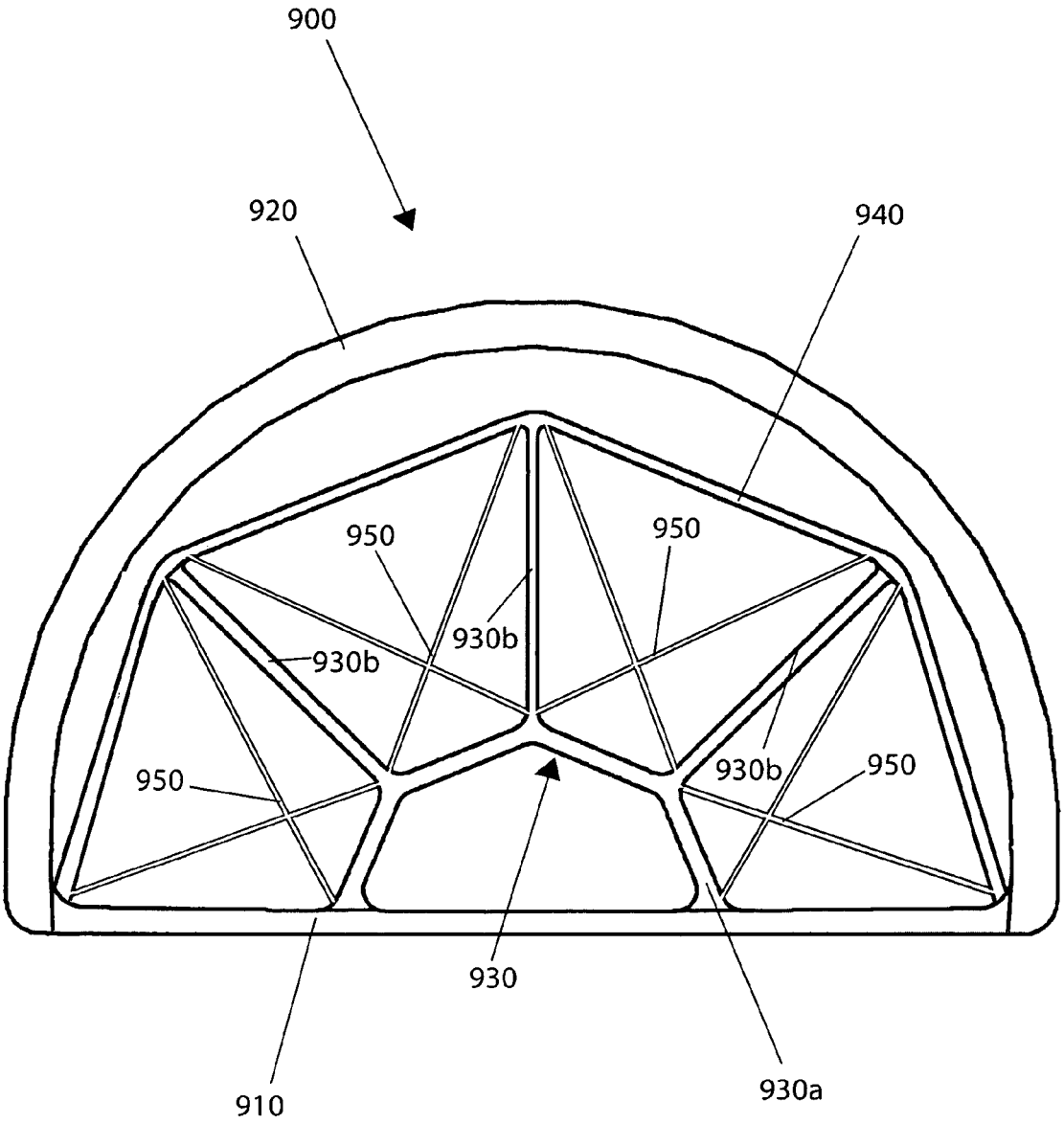
FIG. 9 is a schematic top view of an exemplary embodiment of a golf club head with an exemplary embodiment of a torsion control system, the golf club head designed to act, under impact load, as a bridge.

FIG. 9 is a schematic of an exemplary embodiment of a golf club head designed to act, under impact load, as a bridge. In golf club head 900 (which is similar in structure to golf club head 200), a torsion control system, identified as cross-brace 950, is connected between the various approximate intersections of rear structure 940, and/or inner structure 930*a*, and/or radial structure 930*b*, and/or face 910. Like cross-brace 850, cross-brace 950 provides torsional resistance to force transfer system 930. In other words, in connection with inertial support system 920, cross-brace 950 opposes the internal "rotation" (relative to inertial support system 920) of force transfer system 930 resulting from an off-center impact load.

Figure 10:
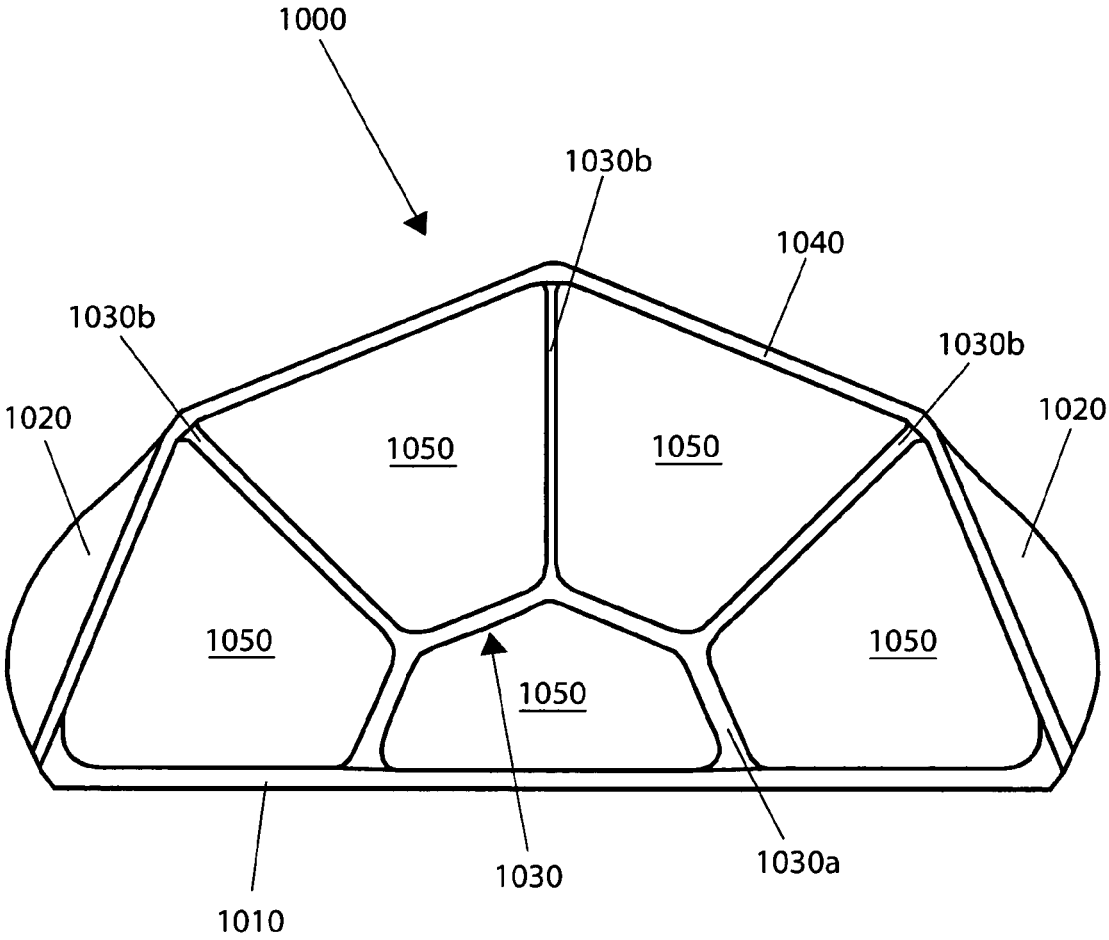
FIG. 10 is a schematic top view of an exemplary embodiment of a golf club head with an exemplary embodiment of a torsion control system, the golf club head designed to act, under impact load, as a bridge.

FIG. 10 is a schematic of an exemplary embodiment of a golf club head designed to act, under impact load, as a bridge. In golf club head 1000 (which is similar in structure to golf club head 500), a torsion control system, identified as insert 1050, is placed in the "opening" between force transfer system 1030 and rear structure 1040 and/or in the "opening" between force transfer system 1030, rear structure 1040 and face 1010, and/or in the "opening" between force transfer system 1030 and face 1010. As shown in FIG. 11*a*, insert 1050 is a "cored out" structure that comprises two component parts, web 1052 and flange 1054. In contrast, insert 1050 may be a solid structure (not shown). In an alternate embodiment, as shown in FIG. 11*b*, insert 1050 may further comprise a cross-brace, such as cross-brace 1056. Insert 1050 may also comprise a flange, such as flange 1054, and a cross-brace, such as cross-brace 1056. Insert 1050 may be composed of an assembly of multiple elements, the elements composed of metal, plastic or composite materials. Insert 1050 may also be composed, in whole or in part, of foam.

In addition, web 1052 may have constant wall thicknesses, multiple wall thicknesses, varying wall thicknesses or profiled wall thicknesses. For example, the inner edge of web 1052 (near inner structure 1030*a*) may be thicker than the outer edge of web 1052 (near rear structure 1040 or inertial support system 1020). In another alternate embodiment, the thickness of web 1052 may mirror the thickness of radial structure 1030*b*. It may also be profiled to conform with the deformation of radial structure 1030*b* under center impact loading.

Like cross-braces 850 and 950, insert 1050 provides torsional resistance to force transfer system 1030. Thus, in connection with inertial support system 1020, insert 1050 opposes the internal "rotation" (relative to inertial support system 1020) of force transfer system 1030 resulting from an off-center impact load.

In tuning performance of the golf club head, the torsion control system (whether a cross-brace, an insert, or some combination of both) may be positioned at any point along the height of the force transfer system. In addition, the torsion control system may be positioned at different points along the height of the force transfer system for each "opening" in the golf club head. Further, one or more "openings" in the golf club head may contain more than one component of the torsion control system or, in the alternative, contain no component of the torsion control system. A person of skill in the art understands that tuning the torsion control system "tunes" the rate of deflection of the face and, in turn, the impedance match between the face of the golf club head and the ball.

The geometry and/or material property and/or attachment method of the torsion control system may also be varied to tune the performance of the golf club head. The performance tuning may occur at the time of manufacture, at the time of sale, or "in the field"—making the torsion control system re-configurable and/or replaceable. These "sets" of torsion control systems may be designed for the needs of a particular group of golfers or for the needs of a particular golfer.

In an alternate embodiment of each of the exemplary embodiments of golf club heads, the golf club heads may further include a back, such as back 350 in golf club head 300. Or, in further alternative embodiments of each of the golf club heads, the back of the golf club head may be the rear structure or the inertial support system. In addition, the torsion control system may form all (or part) of the sole or crown of the golf club head. When forming all (or part) of the sole or crown of the golf club head, the torsion control system may be composed (in whole or part) of a material that provides scuff resistance for the golf club head, such as a plastic, metal (for example, thin titanium) or composite material (such as a combination of metal and plastic).

In other alternate embodiments of each of the exemplary embodiments of golf club heads, the face may be convex in shape from crown to sole (for example, a "roll") or convex in shape from heel to toe (for example, a "bulge") or convex in shape from crown to sole and heel to toe (for example, a combination of a "roll" and a "bulge").

In a further alternate embodiment of each of the exemplary embodiments of golf club heads, the inertial support system further includes a hosel, such as hosel 450 in golf club head 400. A hosel is a connection point on a golf club head to which a golf club shaft is attached. In addition, the golf club heads may include other "conventional" design options, such as offsets, face angles, loft angles or lie angles.

In still another embodiment of each of the exemplary embodiments of golf club heads, the face, the inertial support system, the force transfer system, the rear structure, and the torsion control system may be integral units alone or in combination with each other. For example, the face and the force transfer system may be an integral unit, the inertial support system may be an integral unit, the face, the force transfer system and the rear structure may be an integral unit, or the torsion control system, the inertial support system and the force transfer system may be an integral unit.

In a further embodiment of each of the exemplary embodiments of golf club heads, the golf club head may further include a conventional crown, a conventional sole, or a conventional crown and a conventional sole. The term "conventional" is used herein to differentiate from the "crown of varying thickness" described in FIG. 7. In order to ensure that a conventional crown or conventional sole do not negatively impact the bridge-like operation of the golf club heads described herein, the conventional crown or conventional sole may be composed of a thermoset elastomer, a thermoplastic elastomer, or an engineering resin. The thermoset elastomer, thermoplastic elastomer, or engineering plastic may be combined with fillers or fibers, such as glass or carbon, to form a composite structure. In addition, the conventional crown or conventional sole may be transparent (in whole or in part) or translucent (in whole or in part).

Although various exemplary embodiments of the invention have been disclosed, it should be apparent to those skilled in the art that various changes and modifications can be made which will achieve some of the advantages of the invention without departing from the true scope of the invention. These and other obvious modifications are intended to be covered by the appended claims.

What is claimed is:

1. A golf club head comprising:

a face, the face comprising a front side and a back side; and a face-supporting structure, the face-supporting structure connected to the back side of the face at at least two points;

in a substantially on-center impact with a golf ball, the face deforming, with respect to the face-supporting structure, a first amount and the face-supporting structure deforming a second amount; and in an off-center impact, the face-supporting structure deforming at an amount greater than the second amount when the face deforms, with respect to the face-supporting structure, at an amount less than the first amount, the changes in the amounts resulting in a club head with approximately the same compliance occurring over a portion of the face.

2. The golf club head according to claim 1 in which the portion of the face comprises at least approximately 25% of the face.

3. The golf club head according to claim 1 in which the face-supporting structure is a force transfer system or a force transfer system and a rear structure, the proximal side of the rear structure connected to the distal side of the force transfer system at at least one point.

4. The golf club head according to claim 3 in which the golf club head further comprises an inertial support system, the inertial support system connected to the face-supporting structure or connected to the edges of the face, the mass of the inertial support system being at least approximately equal to the combined mass of the face and the face-supporting structure.

5. The golf club head according to claim 1 in which at least a portion of the face-supporting structure is separated into a top portion and a bottom portion, the top portion of the portion of the face-supporting structure connected to the face at at least two points and the bottom portion of the portion of the face-supporting structure connected to the face at at least two points.

6. The golf club head according to claim 1 further comprising:

a torsion control system, the torsion control system connected to the back side of the face at at least one point or to the proximal side of the rear structure at at least one point, during off-center impact the torsion control system controlling the internal rotation of at least a portion of the face-supporting structure.

7. The golf club head according to claim 6 in which the torsion control system comprises a cross-brace, an insert, a combination of a cross-brace and an insert, or a combination of a cross-brace and a portion of an insert.

8. The golf club head according to claim 7 in which the insert comprises a constant wall thickness, a multiple wall thickness, a varying wall thickness, or a profiled wall thickness.

9. The golf club head according to claim 6 in which the torsion control system is re-configurable or replaceable.

10. The golf club head according to claim 1 in which the golf club head further comprises a crown.

11. The golf club head according to claim 1 in which the golf club head further comprises a sole.

* * * * *